US005771525A

United States Patent [19]

Fulcher et al.

[11] Patent Number: 5,771,525

[45] Date of Patent: Jun. 30, 1998

[54] DRYWALL AND STUCCO APPLICATION DEVICE

[76] Inventors: Paula C. Fulcher; Donald L. Fulcher, both of 1079 SW. Benchor Ave., Port St. Lucie, Fla. 34953

[21] Appl. No.: 707,994

[22] Filed: Mar. 11, 1996

[51] Int. Cl.[6] ..... B05C 17/10

[52] U.S. Cl. ..... 15/244.1; 15/145; 15/235.4; 425/458; D4/137

[58] Field of Search ..... 15/104.001, 143.1, 15/144.1, 145, 235.4, 244.1; 425/458; D4/119, 120, 137; D32/40

[56] References Cited

U.S. PATENT DOCUMENTS

| | | | |
|---|---|---|---|
| 137,805 | 4/1873 | Stranahan | 15/143.1 |
| D. 353,940 | 1/1995 | Joyner et al. | D4/120 |
| 399,308 | 3/1889 | Wright | 15/143.1 |
| 2,789,305 | 4/1957 | Weil | 15/244.1 |
| 3,081,476 | 3/1963 | Moshem | 15/244.1 |
| 5,226,198 | 7/1993 | Martin | 15/145 |
| 5,279,015 | 1/1994 | Meiring | 15/244.1 |
| 5,542,352 | 8/1996 | Blackman et al. | 15/210.1 |
| 5,580,608 | 12/1996 | Capoccia | 15/235.4 |

*Primary Examiner*—Terrence Till
*Attorney, Agent, or Firm*—Brian S. Steinberger; Law Offices of Brian S. Steinberger

[57] ABSTRACT

A device for recreating knockdown patterns on walls, ceilings and surfaces. The device includes approximately six foam prong fingers having exposed lengths of approximately ¼ to 1 and ½ inches long arranged in a bundle, and approximately ¼ to approximately 2 inches in diameter. One end to bundle is cinched and held within a hand grip allowing the opposite end to form a splay pattern. Including the cinch portion each of the foam prongs can be approximately 1 to 3 inches in length. The outer exposed ends of the bundle can have flat perpendicular cuts and sliced forty five degree angled cuts. An optional extension pole allows the device to be used in hard to reach areas.

13 Claims, 4 Drawing Sheets

DRYWALL AND STUCCO APPLICATION DEVICE

This invention relates to creating textured patterns using texture mediums such as drywall joint compounds, plaster, and stucco on ceilings, walls and other drywall surfaces, and in particular to a handheld device with expanding foam prongs having a staggered pattern that can be manually used to daub on texture medium to simulate and match knock down texture patterns on walls, ceilings and other surfaces. This invention claims priority to a provisional application entitled: Drywall, Plaster or Stucco Knock-down Texture Manual Applicator, No. 60/002,327 filed on Aug. 14, 1995.

BACKGROUND AND PRIOR ART

Many ceilings and walls in residential and commercial properties have on their surfaces a knock-down texture patterns. Problems in duplicating these patterns are very common when the wall and ceiling surface areas need to be repaired. Small surface areas further exacerbate the problem since it is extremely difficult to match the existing texture pattern of the repaired area to its surrounding areas.

Various attempts have been made unsuccessfully to create or duplicate these texture patterns manually. For example, conventional knock-down texture applicators in the form of compressor driven systems with applicator guns which dispense plaster like texture material by pressure through an orifice are very expensive to own and require a lot of preparation time. Furthermore, template sheets having small openings cut out are then laid over the areas to be repaired and handheld sprayers pump out gypsum type mud over the template. Besides the cost of the templates, and pumps, this form of repair is quite messy to clean up.

Dispensers such as aerosol spray-on dispensers are currently sold over-the-counter and cover a few square feet, but can not be reused. Along with the waste of throwing out old aerosol dispensing containers, new aerosol containers must be constantly purchased. Tradesmen try to simulate the knock-down texture using their bare hands, aerosol dispensers, air driven hoppers, sponges, brushes or paper. However, most of these techniques require extra preparation time and materials such as masking off non treated areas with tape. Furthermore, most of these prior techniques require additional time and expense for cleanup of the worksite. Further, none of these alternative methods can adequately duplicate the knock-down texture sprayed from a pressurized compressor driven system such as a drywall spray rig.

Several U.S. Patents have been proposed in this area but still fail to solve the above mentioned problems. U.S. Pat. Nos. Des. 96,694 to Porter; Des. 288,987 to Bambury; and Des. 320,698 show handheld brushes that do not solve the above stated problems and fail to recreate a texture knock-down pattern. Further U.S. Pat. No. 3,010,133 to Hurd; U.S. Pat. No. 3,029,459 to Pruitt; U.S. Pat. No. 3,846,060 to Otis; and U.S. Pat. No. Des. 279,544 to Duncan describe handheld flat sponges and tools that likewise do not adequately solve the problems presented above.

Thus, the need exists for a solution to the above stated problems with the prior art.

SUMMARY OF THE INVENTION

The first objective of the present invention is to provide a manual handheld tool that can duplicate a knock-down texture wall, ceiling and surface pattern that was created by a compressor driven pressurized system such as a dry wall spray rig.

The second object of this invention is to provide a manual handheld tool that can repair a knock-down texture wall, ceiling and surface pattern with minimal preparation, cleanup and time spent.

The third object of this invention is to provide a manual handheld tool for creating knock-down texture patterns that can be reused multiple times without having to be replaced.

The fourth object of this invention is to provide a manual handheld tool for creating knock-down texture patterns that only needs to be rinsed off with water before being reused.

The fifth object of this invention is to provide a manual handheld tool for creating knockdown texture patterns that does not require extra cleanup time and extra preparation expense such as masking off unaffected areas before being used.

The sixth object of this invention is to provide a manual handheld tool for creating knockdown texture patterns that eliminates the mess and cleanup associated with using prior techniques.

The novel invention allows a drywall serviceman to complete a knock-down texture repair on wall and ceiling patterns in one day, where in the past dry wall type spray rigs usually required a second day to come to a repair site. Unlike aerosol cans, the novel invention can be reused many times before having to be replaced.

A preferred embodiment of the invention has six(6) foam prong rods formed from polyethylene foam being cinched together at their base end to a handle. The handle has annular sides with a grooved indentation about the mid-section. An optional extension pole having a threaded end can fit within a threaded receptacle inside of the handle opposite to the cinched ends of the prong rod fingers. Each of the foam fingers can be approximately ¼ to approximately 1 & ½ inches in length exposed(approximately 1 to 3 inches including cinch portion) and approximately ¼ to approximately 2 inches in diameter.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
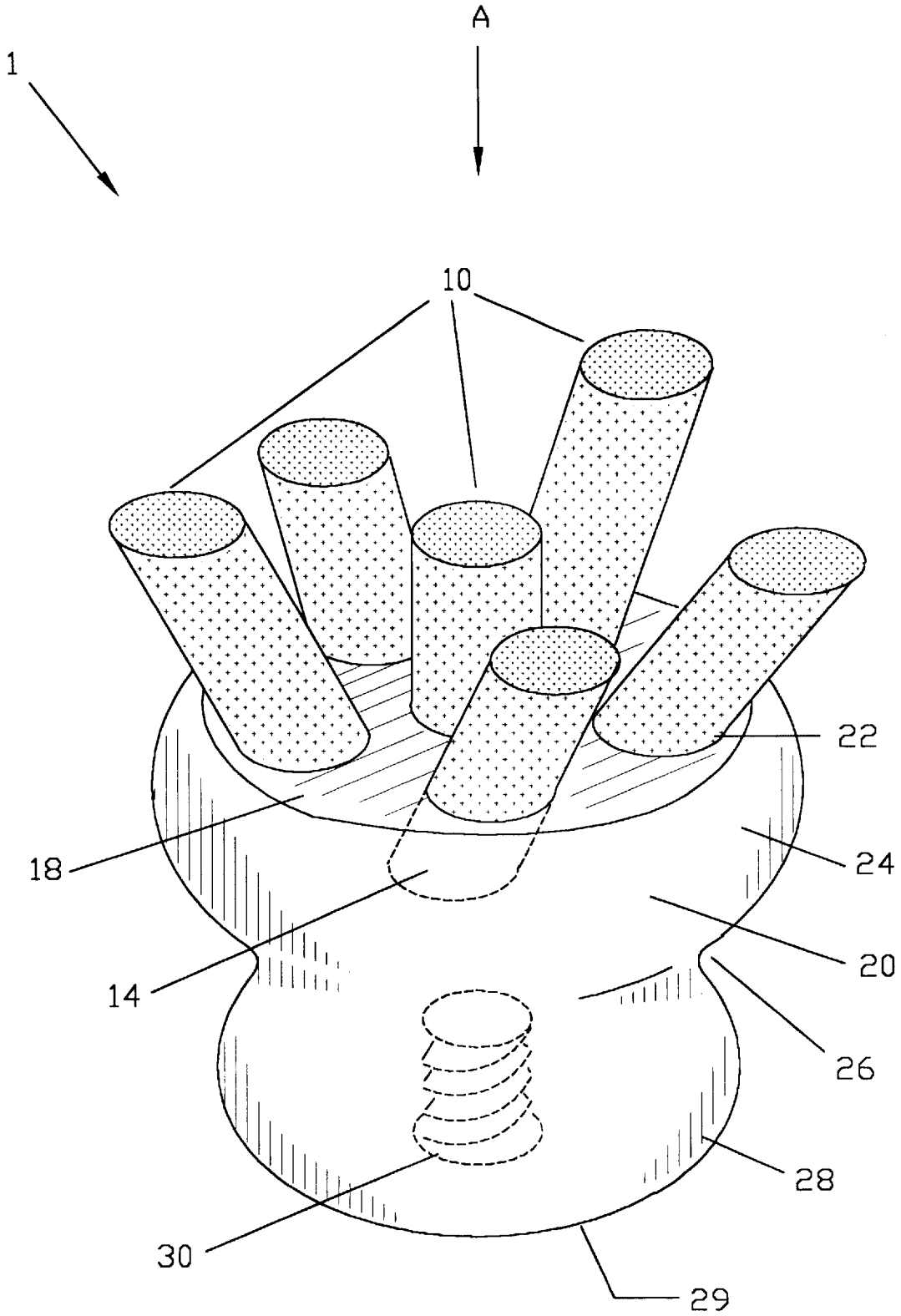
FIG. 1 is a perspective view of a preferred embodiment of the novel drywall, plaster and stucco device.
Figure 2:
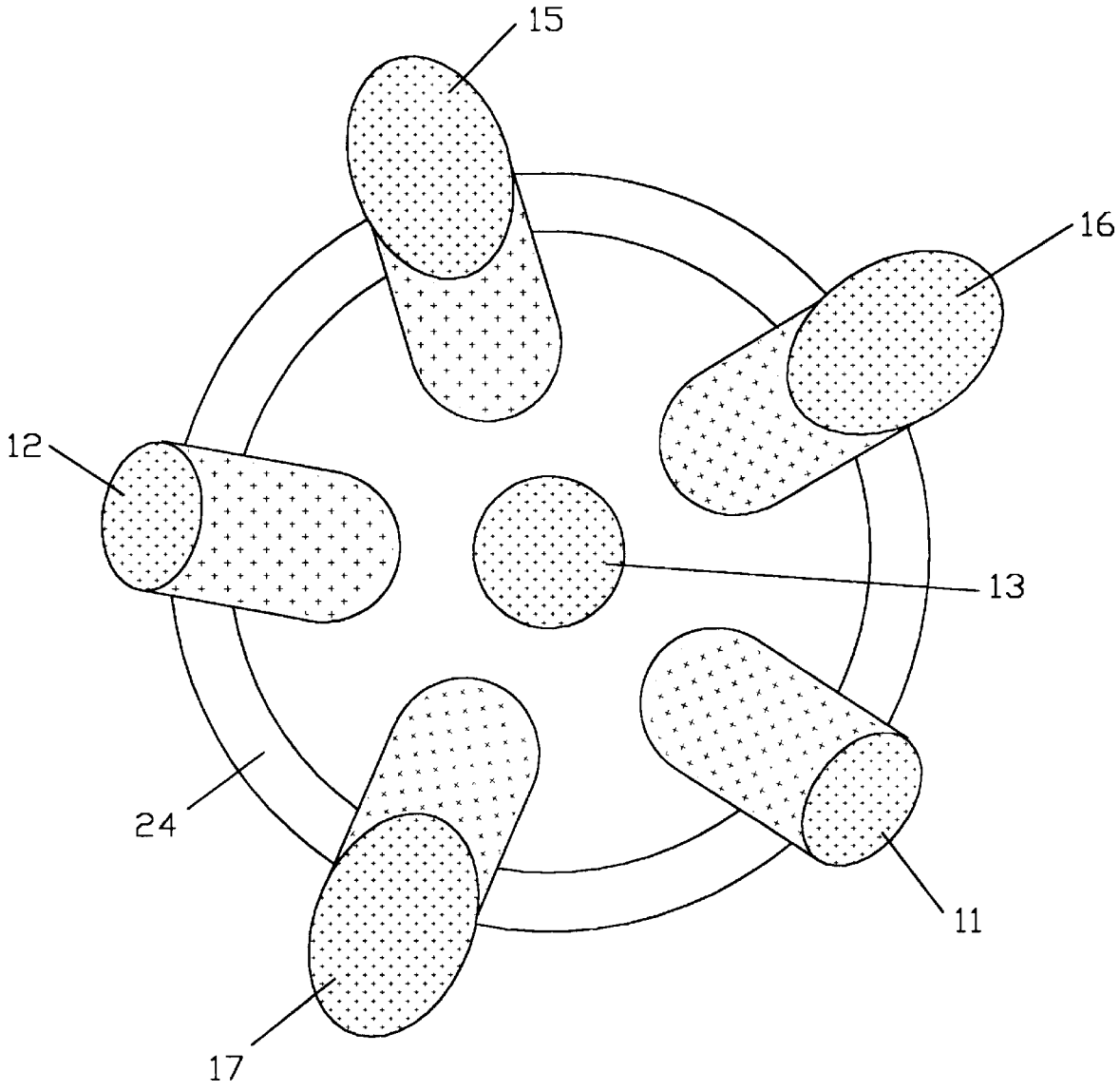
FIG. 2 is a top view of device of FIG. 1 along arrow A.

FIG. 1 is a perspective view of a preferred embodiment of the novel drywall, plaster and stucco device 1. FIG. 2 is a top view of device 1 of FIG. 1 along arrow A. Referring to FIGS. 1 and 2, device 1 includes six(6) closed cell polyethylene foam rod fingers 10 having top flat ends 11–13 in an expanding splay pattern configuration with lower ends 14 cinched and affixed within a hollow portion 22 of handle 20 by adhesive, glue, plastic cement and the like. Each of the six(6) shown foam fingers can be approximately ¼ of an inch to approximately 1 and ½ inches in length exposed (approximately 1 to 3 inches including cinch portion) with between approximately ¼ of an inch to approximately two inch diameter. The tops of three rods 15, 16, and 17 can be cut at an angle of approximately forty-five degrees while remaining three rods 11–13 can have flat ends that are perpendicular to the longitudinal axes of their respective rods. Handle 20 further includes an annular upper half portion 24 having rounded outer edges, a concave rounded indentation 26 running around the mid-section of the handle and a lower annular wall portion 28 having rounded outer edges. Lower annular wall portion 28 has a smaller diameter than upper annular wall portion 24. The lower end 29 of handle 20 has a flat surface and a threaded interior cavity 30. Handle 20 can be preformed from wood, injection molded plastic and the like.

Figure 3:
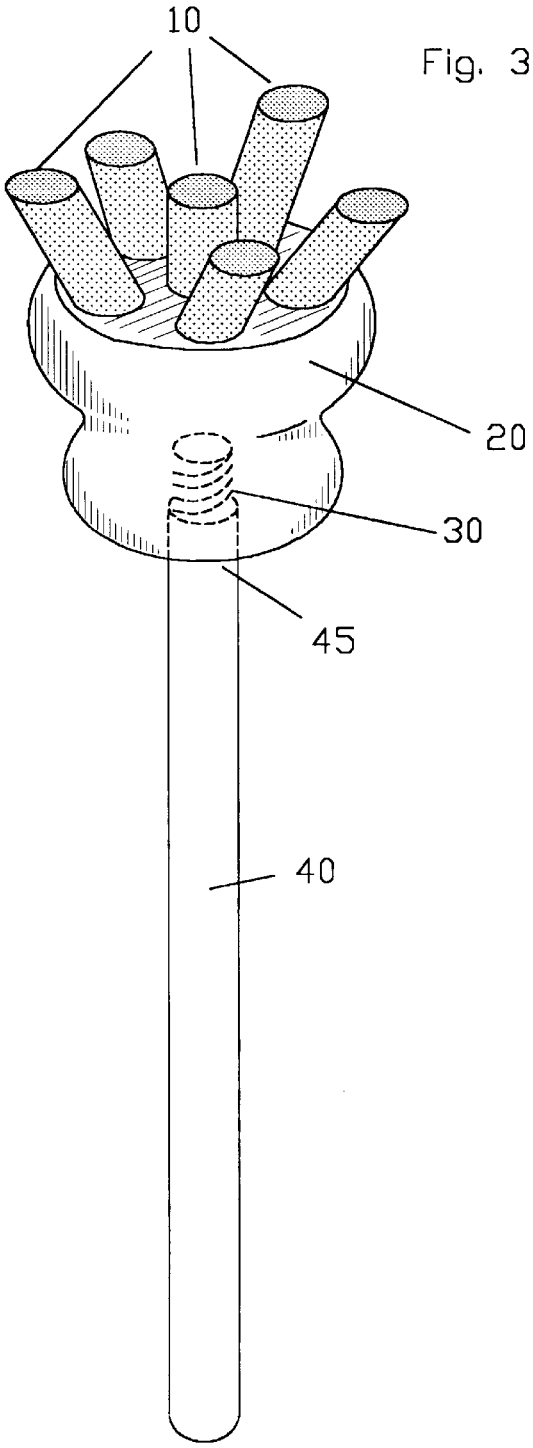
FIG. 3 is a second view of the novel invention of FIG. 1 attached to an extension pole.

FIG. 3 is a second view of the novel invention of FIG. 1 attached to an extension pole 40 that can be approximately one to four feet in length and formed from plastic, metal, wood and the like. Upper end 45 of pole 40 can have threads that are mateably threaded to an internal threaded cavity 30 of device 1. The extension pole 40 can allow the user to reach ceiling and upper wall locations that may be out of a normal arm's reach.

Figure 4:
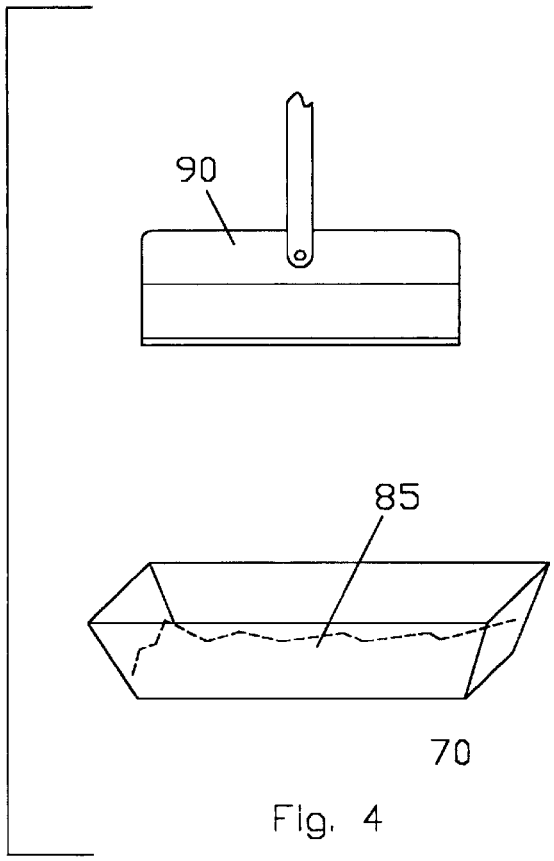
FIG. 4 is a side view of a typical drywall mud pan that holds a drywall joint compound, plaster, or stucco material along with a generic drywall knife.
Figure 5:
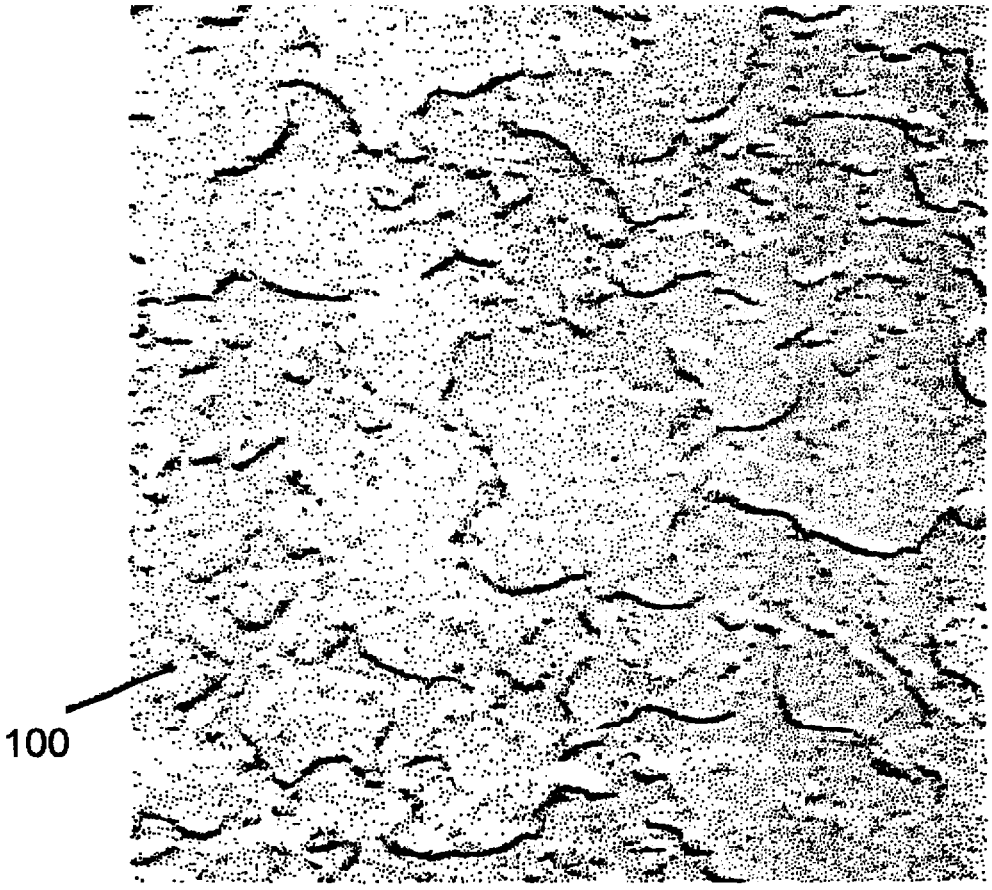
FIG. 5 is an enlarged view of a knockdown drywall, plaster and stucco type pattern that can be achieved with the novel invention device.

FIG. 4 is a side view of a drywall mud pan 70 that can hold a drywall joint compound, plaster, or stucco material 85 along with a generic putty knife 90. In operation, a user gripping holder 20 or using rod 40 has tip ends 11–13 and 15–17 dipped into the material 85 and then daubed onto the prepared drywall repair area such as part of a wall, ceiling and surface until the desired area is completely cover. The user applies light pressure to transfer the texture compound onto the surface being textured. Then with a broad type drywall knife 90, the pattern is lightly knocked down into a pattern such as the one shown as 100 in FIG. 5.

Although the preferred embodiments describe using closed cell polyethylene foam, other types of plastic foam material such as but not limited to polyurethane foam, rubber, plastic and sponge material can be used.

While the preferred embodiment is described using six(6) foam rods, the invention can have applicability to more or less rods depending upon the application to be duplicated.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A manual handheld tool for creating knock-down texture wall, ceiling and surface patterns, the tool comprising:

a handheld grip;

plural closed cell polyethylene foam prongs arranged side-by-side in a bundle, the bundle having a top end and a lower end, the lower end of the bundle attached to one side of the grip, and the top end of the bundle of prongs expanding out in a splay pattern, wherein the prongs create knock-down texture patterns on walls, ceilings and surfaces.

2. The manual handheld tool of claim 1, wherein the prongs include:

approximately six(6) prongs.

3. The manual handheld tool of claim 2, wherein the top ends of the prongs includes:

at least the top end of one prong having an angled cut of approximately forty-five degrees.

4. The manual handheld tool of claim 3, further including:

a first group of prongs in the bundle having a top end cut of approximately forty-five degrees; and a second group of prongs in the bundle having a flat cut perpendicular to the interior prongs vertical axes.

5. The manual handheld tool of claim 1, wherein each of the foam prongs include:

an exposed length of approximately ¼ inch to 1 and ½ inches long.

6. The manual handheld tool of claim 1, further comprising:

an extension rod for attachment to the hand grip.

7. The manual handheld tool of claim 1, wherein the extension rod further includes:

a threaded end for rotatably being attached to mating threads within the hand grip.

8. A manual handheld tool for creating knock-down texture wall, ceiling and surface patterns the tool comprising:

a handheld grip having a first annular ring with rounded edges and a first diameter, and a second annular ring with rounded edges and a second diameter smaller than the first diameter of the first annular ring, wherein a concave rounded indentation is formed between the first annular ring and the second annular ring; and plural foam prongs arranged side-by-side in a bundle, the bundle having a top end and a lower end, the lower end of the bundle attached to the first annular ring of the grip, and the top end of the bundle of prongs expanding out in a splay pattern, wherein the prongs create knock-down texture patterns on walls, ceilings and surfaces.

9. The manual handheld tool of claim 8, wherein each of the foam prongs include:

closed cell polyethylene foam rods.

10. The manual handheld tool of claim 8, further comprising:

an extension rod for attachment to the hand grip.

11. The manual handheld tool of claim 10, wherein the extension rod further includes:

a threaded end for rotatably being attached to mating threads within the hand grip.

12. The manual tool of claim 10, wherein each of the foam prongs includes:

a diameter of approximately ¼ to 2 inches in diameter.

13. A manual handheld tool for creating knock-down texture wall, ceiling and surface patterns, the tool comprising:

a handheld grip;

plural foam prongs arranged side-by-side in a bundle, wherein a first group of the plural foam prongs has a forty-five degree angled top cut, and a second group of the plural foam prongs has a flat top cut, the bundle having a top end and a lower end, the lower end of the bundle attached to one side of the grip, and the top end of the bundle of prongs expanding out in a splay pattern, wherein the plural prongs create knock-down texture patterns on walls, ceilings and surfaces.

* * * * *